US006197210B1

(12) United States Patent
Myerson

(10) Patent No.: US 6,197,210 B1
(45) Date of Patent: Mar. 6, 2001

(54) PROCESS FOR TREATING BRASS COMPONENTS TO SUBSTANTIALLY ELIMINATE LEACHABALE LEAD

(75) Inventor: Allan S. Myerson, Suffern, NY (US)

(73) Assignee: Gerber Plumbing Fixtures Corp., Chicago, IL (US)

( * ) Notice: Subject to any disclaimer, the term of this patent is extended or adjusted under 35 U.S.C. 154(b) by 0 days.

(21) Appl. No.: 09/135,139

(22) Filed: Aug. 17, 1998

(51) Int. Cl.[7] ..... C23F 1/44

(52) U.S. Cl. ..... 216/106; 216/108; 134/3; 148/DIG. 51; 423/98; 423/658.5

(58) Field of Search ..... 134/1, 3, 10, 28, 134/29, 41; 216/84, 93, 100, 105, 106, 108; 148/508, 558, 679, 680, 681, 682, 683, 684, 686, 687, 709, DIG. 51; 423/89, 92, 98, 658.5

(56) References Cited

U.S. PATENT DOCUMENTS 4,488,950 * 12/1984 Pooley et al. ..... 204/116
5,244,539 * 9/1993 McGrath et al. ..... 156/656
5,454,876 * 10/1995 Downey ..... 134/3
5,601,658 * 2/1997 Marinas et al. ..... 134/3
5,707,421 * 1/1998 Joe ..... 75/743
5,755,950 * 5/1998 Bell ..... 205/445
5,919,519 * 7/1999 Tallis ..... 427/239
5,958,257 * 9/1999 Regelbrugge et al. ..... 216/2

* cited by examiner

*Primary Examiner*—Randy Gulakowski
*Assistant Examiner*—Allan Olsen
(74) *Attorney, Agent, or Firm*—Rockey, Milnamow & Katz, Ltd.

(57) ABSTRACT

A process for the treatment of brass components to reduce leachable lead therefrom when the components are exposed to water which includes the steps of first cleaning the brass components with a cleaning agent in the form of a mineral acid, a mineral acid plus an oxidizing agent, ammonium chloride or ferric chloride and then rinsing to remove the cleaning agent. Thereafter, the brass components are contacted with a lead removal reagent after which the brass components are washed again. It is also possible, in the preferred embodiment, to remove any leachable lead remaining on the surface of the brass components by the additional step of treating the brass components with a water soluble acid and thereafter rinsing the components to leave the components substantially free of the acid. The process as disclosed reduces the leachable lead to well within the most stringent state and/or federal guidelines.

96 Claims, 4 Drawing Sheets

PROCESS FOR TREATING BRASS COMPONENTS TO SUBSTANTIALLY ELIMINATE LEACHABALE LEAD

The present invention is directed to the treatment of brass components to reduce leachable lead therefrom, and particularly brass components which are exposed to water intended for human consumption.

BACKGROUND OF THE INVENTION

As is well known in the art, brass has been widely used for plumbing fittings and fixtures, and a host of other applications in which it comes into contact with substances intended for human consumption. Brass has found particular applicability for use in the manufacture of faucets, valves, fittings and related plumbing products designed for use in delivering potable water in commercial and residential structures.

Brass is an alloy composed principally of copper and zinc. In virtually all applications, however, relatively small amounts of lead are typically added to the alloy to facilitate metal working of the brass including promoting its machineability. Indeed, machineability is particularly desirable when the brass is to be used for plumbing components since those components generally require the cutting of threads and the like.

The lead atoms, because of their atomic size, are larger than atoms of copper or zinc. As a result, lead exhibits a relatively low solubility in solid solution in brass alloys. Those characteristics of lead thus promotes the tendency of lead to precipitate in lead-rich regions dispersed throughout the brass alloy, and particularly near the surface of the brass. The presence of lead-rich regions near the surface of the brass components provides a real advantage in terms of the machineability of the brass adjacent to the surfaces thereof. Unfortunately, however, that same effect increases the tendency of the lead present on or near the surface to leach into water when the brass is used in plumbing applications.

For many years, the quantity of lead leached into foods and liquids from lead-containing plumbing components was generally regarded as sufficiently low that it presented no substantial risk to humans ingesting foods and liquids that had come in contact with those plumbing components. Recent standards at both the state and federal levels, however, have significantly limited the amount of permissible leaching of lead and lead exposure. One example of the more demanding standards is the Safe Drinking Water Act, amended in 1988 to limit lead in solders and fluxes to 0.2% and to limit lead in public water supply pipes and fittings to 8%. As an additional example, California has promulgated regulations limiting lead exposure of humans to less than 0.5 micrograms per day. The EPA in 1991 restructured the standard of lead in drinking water from 50 parts per billion to 15 parts per billion. More recently, a national standard of 11 parts per billion for lead leaching from plumbing fittings and fixtures intended for use with potable water has been implemented under the 1996 amendments to the Safe Drinking Water Act.

While the amount of lead that can be leached from brass plumbing components is generally low, it has been found that the amount of lead that can be leached from plumbing components may exceed either current or future planned standards. It has also been proposed that such standards be made more stringent, resulting in requirements that either lead be omitted totally from the brass alloy or that the brass be treated to ensure only minimum quantities of lead can be leached from brass components.

Similar limitations have been applied to plumbing components in metering devices to meter water to consumers. Water meters, for example, have typically employed brass components in contact with the water to be delivered for the purpose of preventing or minimizing corrosion of the components of the water meters. The corrosion problem is particularly severe when, as is increasingly the situation, such metering devices are buried within the soil and are therefore exposed to the corrosive effects of minerals in the soil.

In U.S. Pat. No. 5,958,257, filed Jan. 7, 1997, it has been proposed that the leachable lead present in brass components, and particularly brass components employed in plumbing applications, can be reduced by a method of treatment of the brass components. In the method described in that co-pending application, new brass components are initially treated with a caustic solution at an elevated pH for the purpose of removing at least some of the leachable lead in the brass component. After rinsing to remove excess caustic, the brass component is thereafter contacted with a water soluble carboxylic acid to remove the remaining leachable lead. While the method disclosed in that co-pending application represents an advance in the art as compared to prior methods, it is nonetheless subject to limitations. One of the principal limitations of the use of an alkali caustic solution is that the rate of removal of lead is relatively slow. In addition, copper oxide also found on the surface of such brass components should likewise be removed, and caustic is not particularly effective in removing such copper oxides in that respect. The limited ability of caustic to effect removal of copper oxide likewise impacts on the removal of lead. Copper oxide needs to be removed to expose additional quantities of lead at the surface of the alloy, and thus the limitations of caustic in the copper oxide removal likewise inhibit the removal of lead as well.

In addition to those shortcomings, the method disclosed in the foregoing co-pending application suffers from the further limitation that the process, while effective, makes use of reagent solutions whose useful bath life is limited. That, in turn, adds to the cost and reduces the feasibility of operating the process in that caustic must be frequently replaced to maintain lead removal at the required high levels.

It is accordingly an object of the present invention to provide a simple, inexpensive and effective process for the treatment of brass components, and particularly brass components for use in plumbing applications, to reduce the leachable lead therefrom.

It is a more specific object of the invention to provide a method for the treatment of brass components which consistently removes leachable lead to levels far below either present or anticipated federal and state health standards.

It is yet another object of the invention to provide a method for the treatment of brass components to remove leachable lead therefrom which is effective both in the treatment of red brass along with yellow brass.

SUMMARY OF THE INVENTION

The concepts of the present invention reside in a process for the treatment of brass components to reduce leachable lead therefrom in which the brass components are chemically treated to remove essentially all of the leachable lead, including the lead from the lead-rich regions near the surface of the fittings, so as to ensure compliance of the brass components with federal and state health standards. The process is applicable to the removal of leachable lead from brass plumbing fixtures such as faucets, shower heads, valves, pipes, pipe fittings, water meters, water pressure and flow regulators to ensure that such devices meet the requirements of various states calling for water containing less than 11, and preferably less than 5, parts per billion of lead.

In the practice of the invention, the brass component is first treated with a cleaning agent in the form of an aqueous solution to remove dirt and residue from the casting of the components and to prepare the surface. The cleaning agent serves not only to oxidize lead present on the surface of the brass components but also to remove copper oxide that would otherwise mask lead from later stages in the process. Thus, the cleaning agent serves to expose surface quantities of the lead for subsequent removal.

The brass component is thereafter washed, preferably with water, and is subjected to the action of a reagent to effect removal of lead. For that purpose, use can be made of either ammonium chloride or an alkali metal hydroxide (e.g. sodium or potassium hydroxide). It has been found that the lead removal reagent serves to remove essentially all of the leachable lead at the surface of the brass component.

Once again, the brass component is washed, preferably with water, to remove essentially all of the lead removal reagent and is thereafter contacted with either an organic or an inorganic acid and preferably a weak acid. The acid serves to remove any lead from the surface of the brass component present there by reason of precipitation from the lead removal reagent. In addition, where an alkali metal hydroxide has been used as a lead removal reagent, the acid serves to remove any remaining quantities of the lead removal reagent by neutralization.

At that stage of the process, the leachable lead, it has been found, has been substantially all removed. It is frequently preferred to subject the brass component to a final rinsing step, again preferably with water, to make sure that all of the reagent used in treating the brass component has been removed from it. It has been found that the method of the present invention is highly effective in removing essentially all of the leachable lead from the brass components, ensuring that the brass components will satisfy any present or contemplated future federal or state standards.

In accordance with one embodiment of the invention, it has been found that it is also possible to omit the final steps of treating the brass component with the acid and the final rinse. As indicated, the acid step serves to not only neutralize the alkali reagents, if any, used as the lead removal reagent, but also for the purpose of eliminating any precipitated lead from the surface of the brass component. So long as complete washing is effected following the use of the lead removal reagent, it is sometimes possible to omit the acid treatment step all together.

DETAILED DESCRIPTION OF THE DRAWINGS

Figure 3:
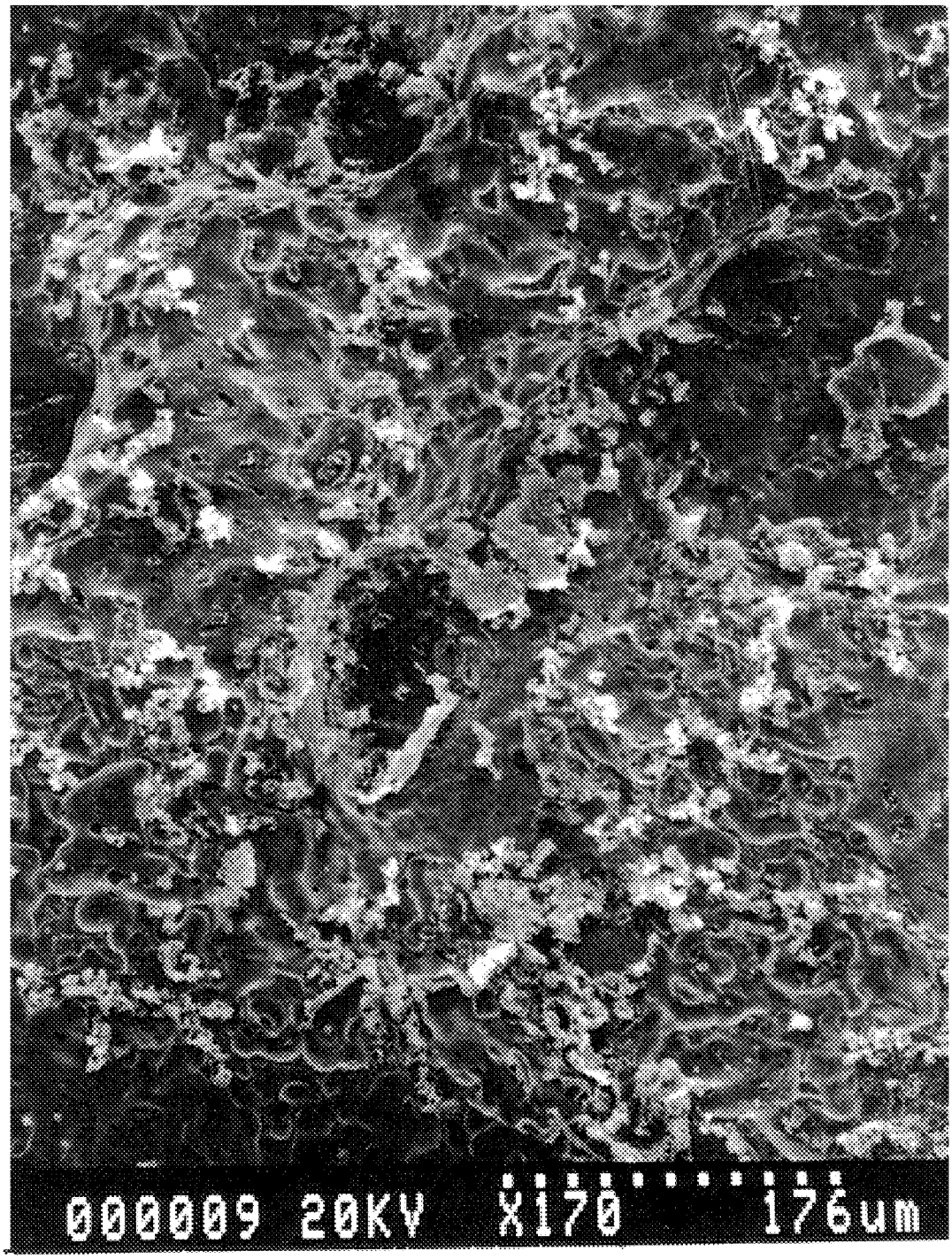
Figure 4:
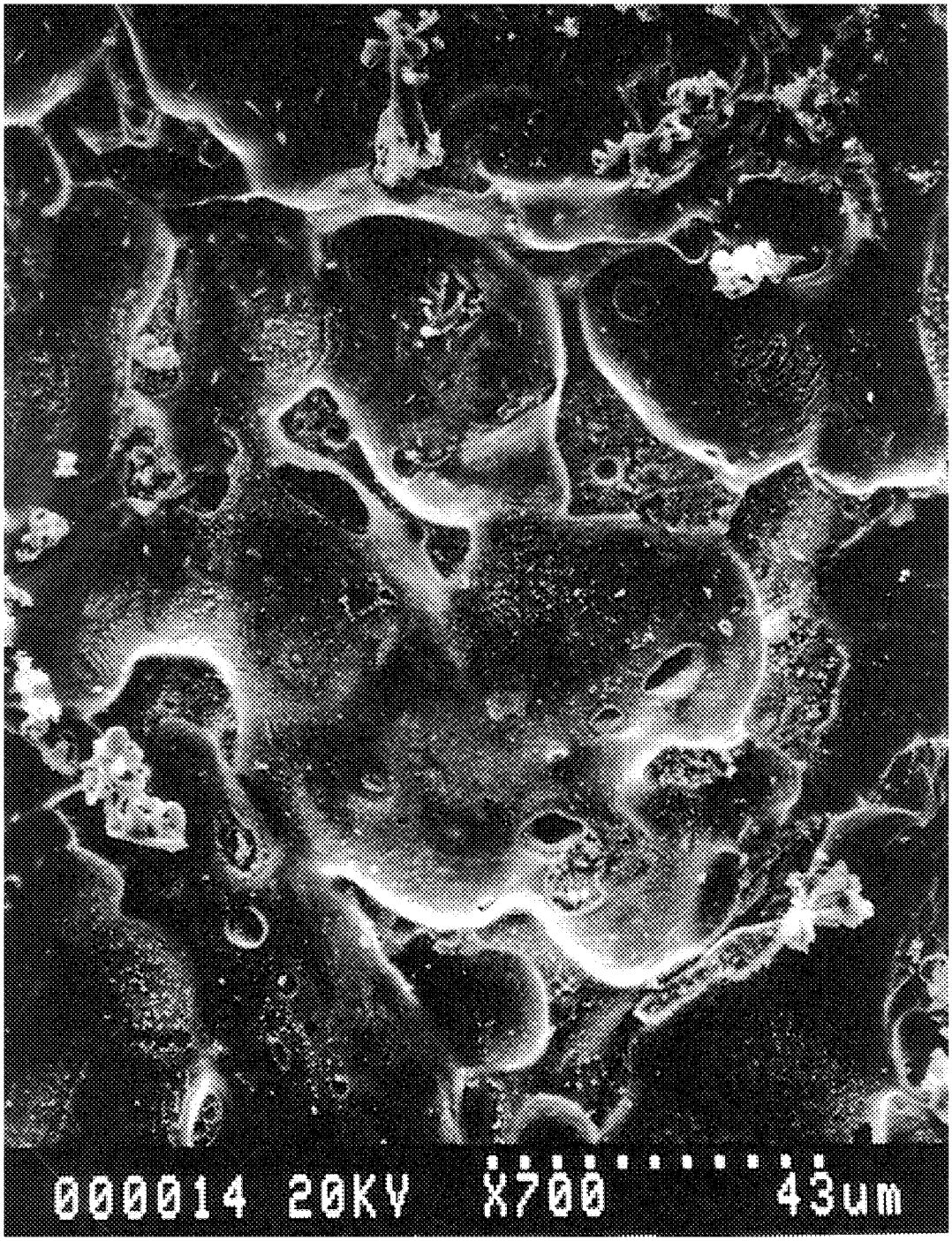

FIG. 3. is a photomicrograph showing the surface of the red brass casting after the lead removal step has been completed; and FIG. 4 is a photomicrograph showing the same surface of the red brass casting after treatment with the acid.

DETAILED DESCRIPTION OF THE INVENTION

In the practice of the present invention, a brass component of the type described which customarily comes into contact with water is first treated with a cleaning agent. The cleaning agent functions to oxidize any lead present on the surface of the brass component and also to remove copper oxide present on the surface. As indicated, the cleaning agent not only serves to remove any dirt and residue from the casting of the component but also serves to prepare the surface.

It has been found that a variety of cleaning agents can be used in the practice of the invention. For example, it is frequently preferred to employ either a mineral acid or a combination of a mineral acid and an oxidizing agent. Preferred in that regard is sulfuric acid, although use can be made of other mineral acids such as nitric acid, phosphoric acids, hydrochloric acids, chromic acid, et cetera. As indicated, the mineral acid can be used either alone or in combination with an oxidizing agent such as hydrogen peroxide or other well known chemical oxidizing agents. Hydrogen peroxide is generally preferred because of cost and safety factors.

It is also possible, and sometimes desirable, to employ, as the cleaning agent ammonium chloride. Without limiting the present invention as to theory, it is believed that the ammonium chloride serves as a cleaning agent by removing the copper oxide and aiding in the oxidation of lead through removal of the initial lead oxide layer along with the lead beneath the initial layer to reoxidize. Whereas ammonium chloride is effective in its own right, it is frequently preferred, when employing ammonium chloride as the cleaning agent, to ensure that sufficient oxygen is dissolved in the cleaning solution to provide a source of oxygen to the lead to facilitate oxidation thereof. In fact, it has been found, in accordance with one embodiment of the invention, that ammonium chloride as a cleaning agent is most effectively used in combination with air agitation of the processing vessel in which the ammonium chloride is present. Not only does the air agitation serve to promote intimate contact between the brass component and the ammonium chloride solution, so too the air provides an abundant source of oxygen to facilitate the oxidation of the lead on the surface of the brass component.

Another cleaning agent which can be effectively used in the practice of the invention is ferric chloride. Since the iron in ferric chloride is present in the +3 oxidation state, the ferric chloride serves as an oxidizing agent, effectively converting lead to lead oxide on the surface of the brass component, thus preparing it for the lead removal reagent used in the next subsequent step.

In general, the concentration of the cleaning agent in aqueous solution with which the brass component is contacted is a concentration sufficient to promote the oxidation of lead on the surface of the brass component to lead oxide and to effectively remove oxide from the surface of the brass component. Of course, the cleaning agent should likewise be present in a quantity sufficient that it will remove adhering foundry sand, brass chips remaining from machining operations and like foreign matter. The precise amount of the cleaning agent is dependent, to some degree, upon the nature of the cleaning agent embodied. When, for example, the cleaning agent is a strong mineral acid alone, a sufficient quantity typically corresponds to 5–40% by weight in aqueous solution based on the total weight of the solution. When ammonium chloride is employed as the cleaning agent, quantities of ammonium chloride ranging from 5–30% by weight in aqueous solution have generally been found to be sufficient. When employing a combination of a mineral acid with an oxidizing agent such as hydrogen peroxide, the oxidizing agent is typically present in an amount within the range of 2–12% by weight in an aqueous solution, accompanied by 0.10 to 10% by weight of the mineral acid. And finally, when ferric chloride is employed, use is typically made of an aqueous solution ranging from about 1–10% by weight based on the total weight of the solution. As will be appreciated by those skilled in the art, such quantities are not critical and can be varied within relatively broad ranges, depending upon the characteristics of the brass being treated, the treating times, and a host of other well understood parameters.

The residence time of the brass component in the aqueous bath containing the cleaning agent is likewise not critical and can be subject to wide variation, depending again on the nature of the brass component being processed, the nature of the cleaning agent employed and the concentration of the cleaning agent. In general, residence times within the range of 10 to 60 minutes are suitable for most applications.

As will be appreciated by those skilled in the art, the effectiveness of the cleaning agent depends not only on the concentration of the cleaning agent and the residence time of the brass component in a bath containing the cleaning agent, but also the temperature as well. In general, higher temperatures favor shorter treatment times while lower temperatures generally necessitate longer treatment times. Best results are usually obtained when the temperature of the cleaning solution containing the cleaning agent is at least 25° C. Higher temperatures can, and frequently are preferred, once again depending upon the nature of the cleaning agent employed. Except in those cases where hydrogen peroxide is used as the oxidizing agent, temperatures ranging from about 20–100° C. are preferred. When employing a cleaning agent utilizing hydrogen peroxide, however, lower temperatures are preferred to ensure the stability of the hydrogen peroxide; temperatures ranging from 20–50° C. are typically employed.

As indicated, the brass component is typically contacted with the cleaning agent in aqueous solution by simply immersing the brass component in that solution. It is frequently desirable to employ ultrasonic agitation of the solution containing the cleaning agent to ensure maximum contact between the solution of the cleaning agent and the brass component. It has also been found desirable, when contacting the brass component with the solution containing the cleaning agent, to rotate the various brass components undergoing treatment for the purpose of removing air pockets which may be formed within the interior of the brass components undergoing treatment. Thus the rotation of the parts during treatment ensures a more uniform treatment of the components.

Once the effect of the cleaning agent has been depleted, the brass component can be removed from the bath containing that cleaning agent, and is preferably washed with water to remove any cleaning agent in contact with the brass component. One or more washing steps can be employed as desired, typically using water alone although various agitation methods to assist in the cleaning operation may also be employed as desired.

After the cleaning agent has been removed, the brass component is thereafter contacted with a lead removal reagent for the purpose of removing essentially all of the leachable lead from the surface of the brass component. The preferred lead a removal reagent is an alkali metal hydroxide, although it will be understood that ammonium chloride can also be used for the purpose of effecting removal of the leachable lead from the surface of the brass component. It is also possible, although frequently not preferred, to use as the lead removal reagent ammonium hydroxide. In general, the use of NH4OH as a lead removal reagent is not preferred because the odor of that reagent necessitates the use of closed baths, contributing adversely to the economics of the process.

When operating the process of the present invention continuously, it is highly desirable to limit the concentration of the lead in the solution containing the lead removal reagent so as to minimize or substantially prevent precipitation of lead from the solution as lead salts. In general, it is preferred to continuously monitor the lead concentration of the solution, ensuring that the lead concentration is maintained below a predetermined limit. For some applications, it is desirable to maintain the solution containing the lead removal reagent such that the concentration of lead in the solution does not exceed 2,000 parts per million, although that limit is subject to variation depending upon a variety of parameters.

One technique for maintaining the lead concentration at or below the desired level is to continuously filter the solution containing the lead removal reagent, thereby filtering out any particulate matter containing lead. It is, of course, also possible, either in place of or in addition to such filtration operations, to either continuously or periodically replenish a portion of the solution containing the lead removal reagent to minimize the concentration of lead in the solution at or below the desired levels.

Another technique that can also be used, either in place of or in addition to the procedures described above, to limit the concentration of lead in solution is that of cementation. Cementation is a spontaneous chemical process involving an electronegative sacrificial metal such as zinc. Such a sacrificial metal gives up some of its electrons to more electropositive metals such as copper and lead whereby lead ions present in the solution are replaced by ions of an electronegative metal such as zinc. The choice of the electronegative sacrificial metal depends upon the well known electromotive series of elements.

Thus in the practice of the present invention cementation is effected by adding a metal above copper and lead in the electromotive series in metallic form to the bath. Preferred for that purpose is finely divided zinc which is added to the solution containing the lead removal reagent and lead and copper ions. Lead and copper thus become deposited or plated on the finely divided zinc and can be removed from the solution by filtration. The amount of electronegative sacrificial metal employed is not critical and can be varied within wide ranges. The quantity should be sufficient to maintain the lead and copper concentrations below predetermined limits, depending upon the particle size of the electronegative sacrificial metal.

In general, the concentration of the lead removal reagent in aqueous solution is an amount sufficient to remove essentially all of the lead remaining on the surface of the brass component. The precise amount of the lead removal reagent is, as those skilled in the art appreciate, dependent upon the nature of the lead removal reagent employed, the nature of the brass component and other well-understood factors. When the lead removal reagent is an alkali metal hydroxide, it is typically preferred to employ an aqueous solution containing 5 to 50% of the alkali metal hydroxide in aqueous solution. Similar amounts of ammonium chloride can likewise be used, and typically range from 5 to 40% by weight ammonium chloride in aqueous solution. As will be appreciated by those skilled in the art, such concentrations are not critical and can be varied within relatively broad ranges.

Similarly, the residence time of the brass component in the aqueous solution containing the lead removal reagent is likewise non-critical and can be varied, depending again on the nature of the brass component, the nature of the lead removal reagent employed and the concentration of the lead removal reagent. In general, residence times within the range of 1 to 60 minutes are suitable for most applications.

The temperature of the aqueous solution in which the lead removal reagent is contained can also be varied within broad ranges. As is the case with the cleaning agent, higher temperatures favor shorter treatment times while lower temperatures generally are accompanied by longer treatment times. Good results are usually obtained when the temperature of the solution containing the lead removal reagent is at least 20° C. Higher temperatures can be used and are frequently preferred. In general, use is made of temperatures ranging from 20 to 125° C.

As is also the case with the cleaning agent, the brass component is typically contacted with the lead removal reagent in aqueous solution by immersing the brass component in the solution. It is frequently desirable to employ ultrasonic agitation of the solution containing the lead removal reagent to ensure maximum contact between the solution of the lead removal reagent and the brass component. It is also desirable to rotate the various brass components undergoing treatment in the solution of the lead removal reagent for the purpose of removing air pockets which may otherwise be formed within the interior of the brass components undergoing treatment. Rotation of the parts during the lead removal step ensures a more uniform treatment of the brass components.

Following the treatment of the brass components with the lead removal reagent, the brass components are removed from the bath and preferably washed with water to remove essentially all of the lead removal reagent. In the preferred practice of the invention, after washing, the brass component is treated with a water soluble, weak acid to remove any leachable lead remaining on the surface of the brass component and to remove any precipitated lead salts. Used for that purpose are organic or inorganic weak acids, including lower alkanoic acids such as acetic acid, propionic acid, butyric acid and the like. Also suitable are weak inorganic acids such as mineral acids of the kind described above. The use of such an acid treatment step not only serves to remove any remaining quantities of lead but also to neutralize any alkali materials present on the surface of the brass component undergoing treatment. At that stage of the process, the leachable lead has been substantially all removed, and the brass component can be washed or rinsed with water to ensure that the brass components are substantially free of any trace amounts of reagents.

It will be understood, however, that the final treatment steps of the weak acid in the final rinse can be omitted so long as complete washing is effected at the conclusion of the treatment of the brass component with the lead removal steps. In general, however, the final steps are typically preferred.

Having described the basic concepts of the invention, reference is now made to the following examples which are provided by way of illustration and not by way of limitation of the invention.

EXAMPLE 1

This example illustrates the treatment of brass components formulated from red brass which has the following composition:

| | Min. | Max. |
|---|---|---|
| Copper | 75.00 | 77.00 |
| Tin | 2.50 | 3.0 |
| Lead | 5.50 | 7.0 |
| Zinc | 13.00 | 16.00 |
| Iron | 0.00 | .35 |
| Antimony | 0.00 | .25 |
| Nickel | 0.00 | .20 |
| Phosphorus | 0.00 | .02 |

-continued

| | Min. | Max. |
|---|---|---|
| Sulfur | 0.00 | .08 |
| Aluminum | none | none |
| Silicon | none | none |

Figure 1:
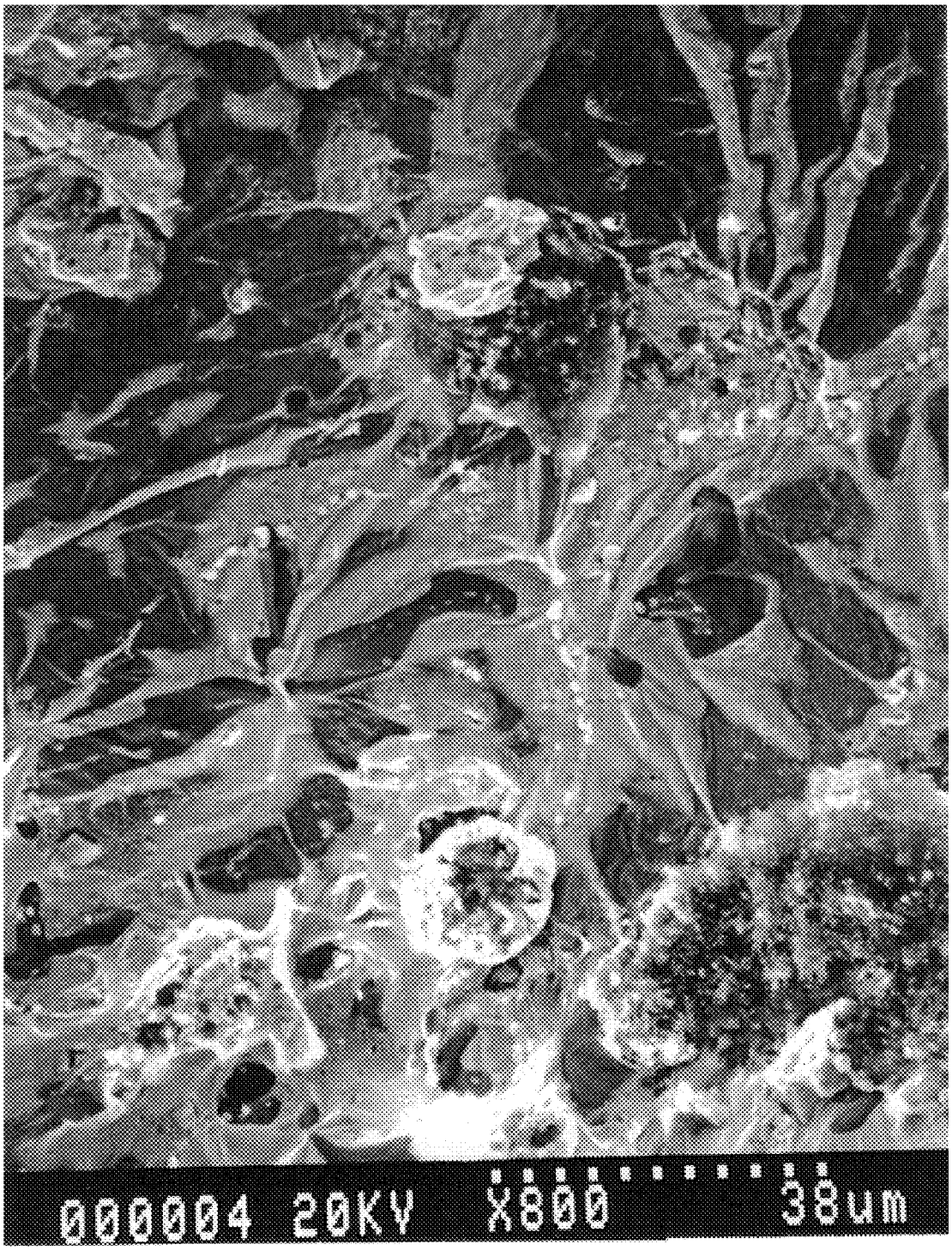
FIG. 1 is a photomicrograph of the surface of a conventional red brass casting prior to any treatment.

Molded plumbing components from red brass having the foregoing composition were first examined under an electron microscope, and the photomicrograph obtained is illustrated in FIG. 1 of the drawings. As can be seen in that Figure, the surface of the brass component includes zinc-lead particles as well as substantial patches of lead on the surface of the brass components.

Figure 2:
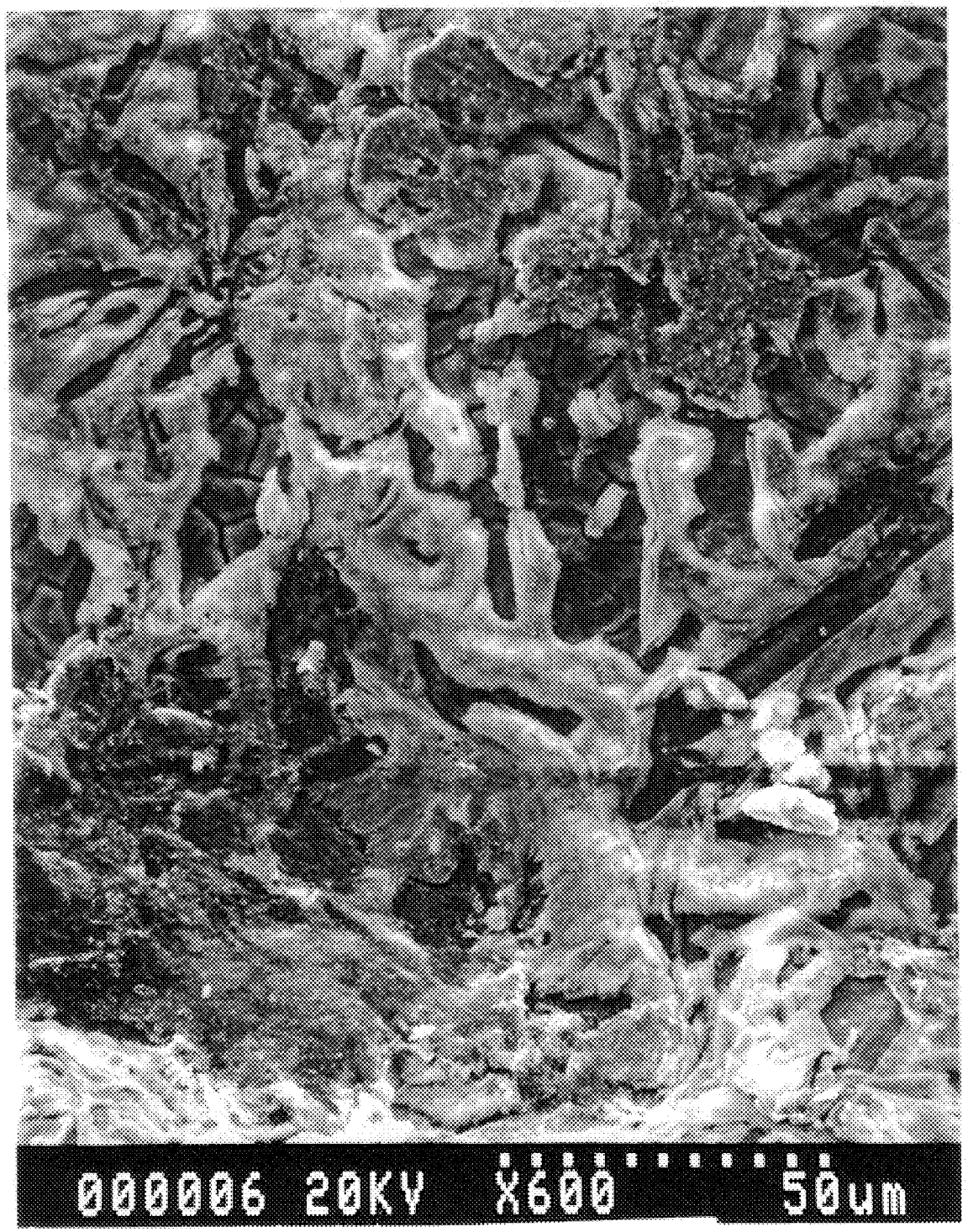
FIG. 2 illustrates the surface of the red brass casting after use of the cleaning agent.

The plumbing components were then immersed in a bath containing a cleaning agent in the form of 8% by weight hydrogen peroxide and 0.5% by weight of sulfuric acid in aqueous solution maintained at a temperature of 40° C. After 15 minutes of immersion in that cleaning solution, the brass components were removed and washed with water. The surface of the brass components were again examined under an electron microscope and the photomicrograph obtained as shown in FIG. 2 of the drawings. As can be seen from that photomicrograph, the surface of the brass components are characterized by lead patches on the surface of the red brass.

Thereafter, the brass components are immersed in a lead removal solution containing 10% by weight of sodium hydroxide in aqueous solution maintained at 70° C. with ultrasonic agitation. After 30 minutes of immersion in the lead removal system, the brass components are removed and washed with water followed by examination under an electron microscope. A copy of the photomicrograph obtained is shown in FIG. 3 of the drawings. As can be seen from that figure, substantially all of the lead has been removed, and what remains on the surface are small quantities of precipitated lead salts.

Following the lead removal treatment, the brass components are treated with acetic acid in a concentration of 0.1 molar maintained at 50° C. with ultrasonic agitation. After 15 minutes of treatment with the acetic acid, the brass components were washed and examined under an electron microscope, the photomicrograph obtained being shown in FIG. 4 of the drawings. As can be seen from that photomicrograph, the surface of the brass components are lead free.

The treating solutions from the foregoing example were analyzed and show a total lead removal of 0.18% of the total mass of the casting, corresponding to 3% by weight of total lead in the casting and a total copper removal of 0.6% of the total weight of the casting or 0.8% of the total copper present in the casting.

EXAMPLE 2

The procedure of Example 1 was repeated, except that the cleaning agent of hydrogen peroxide and sulfuric acid used in Example 1 was replaced by a 20% by weight aqueous solution of ammonium chloride maintained at 70° C. with ultrasonic agitation.

Analysis of the treating solution shows lead removal of 0.18% by weight of the total mass of the casting or 3% by weight of total lead present; the copper removal of only 0.09 percent by weight of the total mass of the casting corresponding to 0.125% by weight of the copper present.

EXAMPLE 3

A red brass casting of the composition given in Example 1 was treated for 10 minutes in the cleaning solution used in Example 1. After water washing, the casting was treated in the lead removal solution used in Example 1 for 30 minutes with ultrasonic agitation. The casting was again water washed and then treated with acetic acid of the composition used in Example 1 for 10 minutes. The casting was then water washed. The casting was subjected to the approved NSF 61 19 day test for leachable lead and the result was a Q value of 3.26. This experiment was repeated with another casting at identical conditions except that the time in the lead removal solution was raised to 60 minutes. The Q value obtained for this casting was 3.05.

EXAMPLE 4

A red brass casting of the composition given in Example 1 was treated for 15 minutes with the cleaning solution of composition and temperature used in Example 2 and employing ultrasonic agitation. The casting was then water washed and treated for 30 minutes with the lead removal solution of composition and temperature used in Example 2 with ultrasonic agitation. The casting was then water washed and treated with acetic acid of composition and temperature used in Example 2 for 10 minutes. The sample was then water washed and tested using the NSF 61 19 day test. The resulting Q value was 2.99. This experiment was repeated with a new casting with all conditions the same except the time of the sodium hydroxide treatment was 60 minutes. The resulting Q value was 2.79.

It will be understood that various changes and modifications can be made in the details of formulation procedure and use without departing from the spirit of the invention especially if as defined in the following claims:

What is claimed is:

1. A process for the treatment of brass components to reduce leachable lead therefrom when the components are exposed to water comprising the steps of:

(a) cleaning the brass components with a cleaning agent selected from the group consisting of mineral acids, a combination of mineral acid plus hydrogen peroxide, ammonium chloride and ferric chloride in aqueous solution in a concentration sufficient to promote oxidization of lead on the surfaces of the brass components and to effectively remove oxide from the surfaces of the brass components;

(b) rinsing the brass components with an aqueous solution to remove the cleaning agent;

(c) removing essentially all of the leachable lead by contacting the brass components with a lead removal reagent selected from the group consisting of ammonium chloride and an alkali metal hydroxide;

(d) contacting the brass components with an aqueous solution to remove the lead removal reagent;

(e) contacting the brass components with a water soluble acid to remove any leachable lead remaining on the surfaces of the brass components and to remove any precipitated lead salts; and (f) rinsing the brass components to leave said component substantially free of the reagents.

2. A process as defined in claim 1 wherein the cleaning agent is ammonium chloride.

3. A process as defined in claim 1 wherein the cleaning agent is a combination of sulfuric acid and an oxidizing agent.

4. A process as defined in claim 3 wherein the oxidizing agent is hydrogen peroxide.

5. A process as defined in claim 1 wherein the cleaning agent is ammonium chloride in aqueous solution having sufficient oxygen dissolved therein to promote oxidization of lead.

6. A process as defined in claim 1 wherein the cleaning agent is a strong mineral acid and is present in aqueous solution in an amount corresponding to about 5 to 40% by weight.

7. A process as defined in claim 1 wherein the cleaning agent is an aqueous solution containing 5 to 30% by weight of ammonium chloride.

8. A process as defined in claim 1 wherein the cleaning agent in aqueous solution contains about 12% by weight of an oxidizing agent and about 0.1 to 10% by weight of a strong mineral acid.

9. A process as defined in claim 8 wherein the mineral acid is sulfuric acid.

10. A process as defined in claim 1 wherein the cleaning agent is an aqueous solution of ferric chloride containing about 1 to 10% by weight of ferric chloride.

11. A process as defined in claim 1 wherein the brass components are contacted with the cleaning agent for a time sufficient to effect cleaning of the surfaces of the brass components.

12. A process as defined in claim 1 wherein the residence time of the brass components with the cleaning agent is within the range of 1 to 60 minutes.

13. A process as defined in claim 1 wherein the temperature of the cleaning agent in contact with the brass components is at least 20° C.

14. A process as defined in claim 1 wherein the brass components are contacted with the cleaning agent at a temperature within the range of about 20 to about 100° C.

15. A process as defined in claim 1 wherein the cleaning agent in aqueous solution is subjected to ultrasonic agitation.

16. A process as defined in claim 1 wherein the lead removal reagent is an alkali metal hydroxide.

17. A process as defined in claim 1 wherein the concentration of lead in the lead removal reagent solution is maintained below a predetermined level.

18. A process as defined in claim 17 wherein the predetermined level is 2,000 parts of lead per million parts of solution.

19. A process as defined in claim 1 wherein the lead removal reagent is in aqueous solution and the aqueous solution is continuously filtered to remove particulate matter containing lead.

20. A process as defined in claim 1 wherein the lead removal reagent is in aqueous solution and the lead content of said solution is maintained at a low level by cementation.

21. A process as defined in claim 20 wherein the cementation is effected by the addition of a finely divided metal to the solution of the lead removal reagent falling above lead and copper in the electromotive series.

22. A process as defined in claim 1 wherein the lead removal reagent is maintained in aqueous solution at a concentration ranging from about 5 to 50% by weight.

23. A process as defined in claim 1 wherein the residence time of the brass components with the lead removal reagent ranges from about 1 to about 60 minutes.

24. A process as defined in claim 1 wherein the temperature of the lead removal reagent in contact with the brass components is at least 20° C.

25. A process as defined in claim 1 wherein the lead removal reagent is in aqueous solution and is subjected to ultrasonic agitation.

26. A process as defined in claim 1 wherein the water soluble acid is selected from the group consisting of organic and inorganic weak acids.

27. A process as defined in claim 1 wherein the water soluble acid is acetic acid.

28. A process for the treatment of brass components to reduce leachable lead therefrom when the components are exposed to water comprising the steps of:

(a) cleaning the brass components with a cleaning agent selected from the group consisting of mineral acids, a combination of mineral acid plus an oxidizing agent, ammonium chloride and ferric chloride in aqueous solution in a concentration sufficient to promote oxidization of lead on the surfaces of the brass components and to effectively remove oxide from the surfaces of the brass components;

(b) rinsing the brass components with an aqueous solution to remove the cleaning agent;

(c) removing essentially all of the leachable lead by contacting the brass components with a lead removal reagent selected from the group consisting of ammonium chloride and an alkali metal hydroxide; and (d) contacting the brass components with an aqueous solution to remove the lead removal reagent.

29. A process as defined in claim 28 wherein the cleaning agent is ammonium chloride.

30. A process as defined in claim 28 wherein the cleaning agent is a combination of sulfuric acid and an oxidizing agent.

31. A process as defined in claim 30 wherein the oxidizing agent is hydrogen peroxide.

32. A process as defined in claim 28 wherein the cleaning agent is ammonium chloride in aqueous solution having sufficient oxygen dissolved therein to promote oxidization of lead.

33. A process as defined in claim 28 wherein the cleaning agent is a strong mineral acid and is present in aqueous solution in an amount corresponding to about 5 to 40% by weight.

34. A process as defined in claim 28 wherein the cleaning agent is an aqueous solution containing 5 to 30% by weight of ammonium chloride.

35. A process as defined in claim 28 wherein the cleaning agent in aqueous solution contains about 12% by weight of an oxidizing agent and about 0.1 to 10% by weight of a strong mineral acid.

36. A process as defined in claim 35 wherein the mineral acid is sulfuric acid.

37. A process as defined in claim 28 wherein the cleaning agent is an aqueous solution of ferric chloride containing about 1 to 10% by weight of ferric chloride.

38. A process as defined in claim 28 wherein the brass components are contacted with the cleaning agent for a time sufficient to effect cleaning of the surfaces of the brass components.

39. A process as defined in claim 28 wherein the residence time of the brass components with the cleaning agent is within the range of 1 to 60 minutes.

40. A process as defined in claim 28 wherein the temperature of the cleaning agent in contact with the brass components is at least 20° C.

41. A process as defined in claim 28 wherein the brass components are contacted with the cleaning agent at a temperature within the range of about 20 to about 100° C.

42. A process as defined in claim 28 wherein the cleaning agent in aqueous solution is subjected to ultrasonic agitation.

43. A process as defined in claim 28 wherein the lead removal reagent is an alkali metal hydroxide.

44. A process as defined in claim 28 wherein the concentration of lead in the lead removal reagent solution is maintained below a predetermined level.

45. A process as defined in claim 44 wherein the predetermined level is 2,000 parts of lead per million parts of solution.

46. A process as defined in claim 28 wherein the lead removal reagent is in aqueous solution and the aqueous solution is continuously filtered to remove particulate matter containing lead.

47. A process as defined in claim 28 wherein the lead removal reagent is in aqueous solution and the lead content of said solution is maintained at a low level by cementation.

48. A process as defined in claim 47 wherein the cementation is effected by the addition of a finely divided metal to the solution of the lead removal reagent falling above lead and copper in the electromotive series.

49. A process as defined in claim 28 wherein the lead removal reagent is maintained in aqueous solution at a concentration ranging from about 5 to 50% by weight.

50. A process as defined in claim 28 wherein the residence time of the brass components with the lead removal reagent ranges from about 1 to about 60 minutes.

51. A process as defined in claim 28 wherein the temperature of the lead removal reagent in contact with the brass components is at least 20° C.

52. A process as defined in claim 28 wherein the lead removal reagent is in aqueous solution and is subjected to ultrasonic agitation.

53. A process for the treatment of brass components to reduce leachable lead therefrom when the components are exposed to water comprising the steps of:

(a) cleaning the brass components with a cleaning agent selected from the group consisting of ammonium chloride and ferric chloride to effect cleaning of the surfaces of the brass components;

(b) rinsing the brass components with an aqueous solution to remove the cleaning agent;

(c) removing essentially all of the leachable lead by contacting the brass components with a lead removal reagent selected from the group consisting of ammonium chloride and an alkali metal hydroxide;

(d) contacting the brass components with an aqueous solution to remove the lead removal reagent;

(e) contacting the brass components with a water soluble acid to remove any leachable lead remaining on the surfaces of the brass components and to remove any precipitated lead salts; and (f) rinsing the brass components to leave said component substantially free of the reagents.

54. A process as defined in claim 53 wherein the cleaning agent is ammonium chloride.

55. A process as defined in claim 53 wherein the cleaning agent is ammonium chloride in aqueous solution having sufficient oxygen dissolved therein to promote oxidization of lead.

56. A process as defined in claim 53 wherein the cleaning agent is in aqueous solution in a concentration sufficient to promote oxidization of lead on the surfaces of the brass components and to effectively remove oxide from the surfaces of the brass components.

57. A process as defined in claim 53 wherein the cleaning agent is an aqueous solution containing 5 to 30% by weight of ammonium chloride.

58. A process as defined in claim 53 wherein the cleaning agent is an aqueous solution of ferric chloride containing about 1 to 10% by weight of ferric chloride.

59. A process as defined in claim 53 wherein the brass components are contacted with the cleaning agent for a time sufficient to effect cleaning of the surfaces of the brass components.

60. A process as defined in claim 53 wherein the residence time of the brass components with the cleaning agent is within the range of 1 to 60 minutes.

61. A process as defined in claim 53 wherein the temperature of the cleaning agent in contact with the brass components is at least 20° C.

62. A process as defined in claim 53 wherein the brass components are contacted with the cleaning agent at a temperature within the range of about 20 to about 100° C.

63. A process as defined in claim 53 wherein the cleaning agent is in aqueous solution which is subjected to ultrasonic agitation.

64. A process as defined in claim 53 wherein the lead removal reagent is an alkali metal hydroxide.

65. A process as defined in claim 53 wherein the concentration of lead in the lead removal reagent solution is maintained below a predetermined level.

66. A process as defined in claim 65 wherein the predetermined level is 2,000 parts of lead per million parts of solution.

67. A process as defined in claim 53 wherein the lead removal reagent is in aqueous solution and the aqueous solution is continuously filtered to remove particulate matter containing lead.

68. A process as defined in claim 53 wherein the lead removal reagent is in aqueous solution and the lead content of said solution is maintained at a low level by cementation.

69. A process as defined in claim 68 wherein the cementation is effected by the addition of a finely divided metal to the solution of the lead removal reagent falling above lead and copper in the electromotive series.

70. A process as defined in claim 53 wherein the lead removal reagent is maintained in aqueous solution at a concentration ranging from about 5 to 50% by weight.

71. A process as defined in claim 53 wherein the residence time of the brass components with the lead removal reagent ranges from about 1 to about 60 minutes.

72. A process as defined in claim 53 wherein the temperature of the lead removal reagent in contact with the brass components is at least 20° C.

73. A process as defined in claim 53 wherein the lead removal reagent in aqueous solution is in contact with the brass components and is subjected to ultrasonic agitation.

74. A process as defined in claim 53 wherein the water soluble acid is selected from the group consisting of organic and inorganic weak acids.

75. A process as defined in claim 53 wherein the water soluble acid is acetic acid.

76. A process for the treatment of brass components to reduce leachable lead therefrom when the components are exposed to water comprising the steps of:

(a) cleaning the brass components with a cleaning agent selected from the group consisting of ammonium chloride and ferric chloride to effect cleaning of the surfaces of the brass components;

(b) rinsing the brass components with an aqueous solution to remove the cleaning agent;

(c) removing essentially all of the leachable lead by contacting the brass components with a lead removal reagent selected from the group consisting of ammonium chloride and an alkali metal hydroxide; and (d) contacting the brass components with an aqueous solution to remove the lead removal reagent.

77. A process as defined in claim 76 wherein the cleaning agent is ammonium chloride.

78. A process as defined in claim 76 wherein the cleaning agent is ammonium chloride in aqueous solution having sufficient oxygen dissolved therein to promote oxidization of lead.

79. A process as defined in claim 76 wherein the cleaning agent is in aqueous solution in a concentration sufficient to promote oxidization of lead on the surfaces of the brass components and to effectively remove oxide from the surfaces of the brass components.

80. A process as defined in claim 76 wherein the cleaning agent is an aqueous solution containing 5 to 30% by weight of ammonium chloride.

81. A process as defined in claim 76 wherein the cleaning agent is an aqueous solution of ferric chloride containing about 1 to 10% by weight of ferric chloride.

82. A process as defined in claim 76 wherein the brass components are contacted with the cleaning agent for a time sufficient to effect cleaning of the surfaces of the brass components.

83. A process as defined in claim 76 wherein the residence time of the brass components with the cleaning agent is within the range of 1 to 60 minutes.

84. A process as defined in claim 76 wherein the temperature of the cleaning agent in contact with the brass components is at least 20° C.

85. A process as defined in claim 76 wherein the brass components are contacted with the cleaning agent at a temperature within the range of about 20 to about 100° C.

86. A process as defined in claim 76 wherein the cleaning agent is in aqueous solution which is subjected to ultrasonic agitation.

87. A process as defined in claim 76 wherein the lead removal reagent is an alkali metal hydroxide.

88. A process as defined in claim 76 wherein the concentration of lead in the lead removal reagent solution is maintained below a predetermined level.

89. A process as defined in claim 88 wherein the predetermined level is 2,000 parts of lead per million parts of solution.

90. A process as defined in claim 76 wherein the lead removal reagent is in aqueous solution and the aqueous solution is continuously filtered to remove particulate matter containing lead.

91. A process as defined in claim 76 wherein the lead removal reagent is in aqueous solution and the lead content of said solution is maintained at a low level by cementation.

92. A process as defined in claim 91 wherein the cementation is effected by the addition of a finely divided metal to the solution of the lead removal reagent falling above lead and copper in the electromotive series.

93. A process as defined in claim 76 wherein the lead removal reagent is maintained in aqueous solution at a concentration ranging from about 5 to 50% by weight.

94. A process as defined in claim 76 wherein the residence time of the brass components with the lead removal reagent ranges from about 1 to about 60 minutes.

95. A process as defined in claim 76 wherein the temperature of the lead removal reagent in contact with the brass components is at least 20° C.

96. A process as defined in claim 76 wherein the lead removal reagent in aqueous solution is in contact with the brass components and is subjected to ultrasonic agitation.

* * * * *